US005163611A

United States Patent [19]

Singer

[11] Patent Number: 5,163,611

[45] Date of Patent: Nov. 17, 1992

[54] BOXES

[76] Inventor: Alec Singer, 24 Wood Road, Rondebosch, Cape Town, Cape Province, South Africa

[21] Appl. No.: 737,264

[22] Filed: Jul. 29, 1991

[30] Foreign Application Priority Data

Aug. 2, 1990 [ZA] South Africa ..... 90/6104

[51] Int. Cl.[5] ..... B65D 5/44

[52] U.S. Cl. ..... 229/199; 229/918; 229/919; 493/89; 493/128

[58] Field of Search ..... 229/199, DIG. 11, 915, 229/918, 919; 493/89, 128, 150

[56] References Cited

U.S. PATENT DOCUMENTS

| | | | |
|---|---|---|---|
| 1,206,898 | 12/1916 | Paridon | 229/199 |
| 3,863,831 | 2/1975 | Wozniacki et al. | 229/DIG. 11 |
| 3,946,934 | 3/1976 | Chaffers | 229/DIG. 11 |
| 4,497,408 | 2/1985 | Jes . | |
| 4,932,530 | 6/1990 | von Zuben et al. | 229/918 |

FOREIGN PATENT DOCUMENTS

| | | | |
|---|---|---|---|
| 489904 | 1/1953 | Canada | 229/199 |
| 1249818 | 11/1960 | France | 229/DIG. 11 |
| 76393 | 8/1961 | France | 229/DIG. 11 |
| 2419869 | 10/1979 | France . | |
| 2609965 | 7/1988 | France . | |
| 2641758 | 7/1990 | France | 229/199 |
| 304718 | 9/1968 | Sweden | 229/DIG. 11 |
| 2226546 | 7/1990 | United Kingdom . | |

OTHER PUBLICATIONS

"The Wiley Encyclopedia of Packaging Technology", John Wiley & Sons, pp. 14–16 (1986).

*Primary Examiner*—Gary E. Elkins
*Attorney, Agent, or Firm*—Ladas & Parry

[57] ABSTRACT

A box is disclosed which comprises three blanks. The blank comprises a rectangular base panel, four wall panels which are joined along crease lines to the panel and four end flaps joined along crease lines to the wall panels. The second and third blanks each comprise a wall panel and two end flaps joined to one another along crease lines. The wall panels are configured to provide a centre section and two end sections with steps between them. The wall panels of the blanks are adhered to the outer faces of wall panels of the blank and the flaps are adhered to the outer faces of the end portions of the wall panels. Re-activatable adhesive is used. The adhesive can be heat, solvent or water reactivated.

8 Claims, 2 Drawing Sheets

BOXES

FIELD OF THE INVENTION

This invention relates to boxes.

BACKGROUND TO INVENTION

Fruit packing seasons are generally very short as all the fruit in a particular area or on a particular farm ripens at about the same time. It must then be picked and packed over a period which could be measured in days but would normally be a few weeks.

What this means in practice is that a packhouse must have a very large number of boxes available to it during the packing season. In a major fruit growing area the number of boxes needed runs into the millions. Obviously, empty but erected boxes require a large amount of storage space and it is not possible to start a packing season with all the boxes that are going to be needed pre-erected and in store. Consequently the boxes are erected during the packing season and immediately thereafter packed. Any delay in the supply of boxes has disastrous results on the ability of the packer to get the fruit to market in prime condition.

Because of these difficulties it has been understood for a long time by those skilled in the art that a machine erectable box would have substantial advantages over the currently used boxes which are hand erected and such boxes have been proposed in the past. However, the boxes of which applicant is aware are complex and costly. The erecting machines are also complex and costly and also tend to be unreliable when operated, in packhouse conditions, by relatively unskilled workers. If such a machine breaks down on a remote farm, and the repair team only arrives after a considerable delay, then valuable packing time is lost.

MAIN OBJECT OF INVENTION

The main object of the present invention is to provide a box which can be erected by hand but which can also be erected by a relatively simple and robust machine.

BRIEF DESCRIPTION OF INVENTION

According to one aspect of the present invention there is provided a box comprising a first blank including a rectangular base panel and four wall panels standing upright along the edges of the base panel, and second and third blanks each of which includes a wall panel and end flaps joined to the ends of the wall panels of the second and third blanks, the wall panels of the second and third blanks being adhered to the outer faces of one opposed pair of wall panels of the first blank and the flaps of the second and third blanks being adhered to the outer faces of end portions of the other pair of opposed wall panels of the first blank.

In the preferred form there are end flaps joined to the ends of said one opposed pair of wall panels of the first blank to which the second and third blanks are secured.

To provide an interlock feature the wall panel of each second and third blank can comprise a centre section the width of which is equal to the height of the wall panel of the first blank to which it is secured, and two end sections which are displaced vertically in the same direction with respect to the centre section thereby to provide steps in the upper and lower edges of the second and third blanks, the upper and lower edges of said centre sections coinciding with the upper and lower edges of the wall panels of said one opposed pair, and the upper and lower edges of the end sections lying above or below the upper and lower edges respectively of the wall panels of the said one pair. It is preferred that the upper edges of the said end sections are above the upper edges of the wall panels of said opposed pair.

The present invention also provides a stack of boxes, the boxes being as defined above, wherein said end sections interlock and said steps are in contact with one another whereby lateral shifting of the boxes with respect to one another is prevented.

According to a further aspect of the present invention there is provided a method of erecting a box the method comprising;

cutting three blanks, the first blank including a rectangular base panel and end and side wall panels joined to the base panel along the four edges thereof, and each of the second and third blanks comprising a wall panel which is longer than the end wall panels of the first blank and which has end flaps at the ends thereof, at least the second and third blanks having thereon re-activatable adhesive;

folding the wall panels of the first blank upwardly with respect to the base panel so that they are erect; folding the end flaps of the second and third blanks so that they are at right angles to the wall panels of the second and third blanks; and adhering the wall panels of the second and third blanks to the outer faces of the end wall panels of the first blank and adhering the end flaps of the second and third blanks to the outer faces of the end portions of the side wall panels of the first blank using said re-activatable adhesive.

According to another aspect of the present invention there is provided a kit from which a box can be erected, the kit comprising first, second and third blanks which in the erected box are adhered to one another, the first blank including a rectangular base panel, opposed end wall panels and opposed side wall panels joined to the base panel along the four edges thereof, and each of the second and third blanks comprising a wall panel which is longer than the end wall panels of the first blank and end flaps at the ends of the wall panel thereof, at least the second and third blanks having thereon re-activatable adhesive for permitting said second and third blanks to be adhered to the outer faces of the end wall panels of the first blank.

The first blank can further include end flaps joined to the ends of the end wall panels thereof.

To provide an interlock feature, the wall panel of each second and third blank can comprise a centre section the width of which is equal to the erected height of the end wall panel of the first blank to which it is to be secured, and two end sections which are displaced in the same direction with respect to the centre section thereby to provide steps in both the upper edges and the lower edges of the first and second blanks.

In this form said centre section and said end sections can be of the same width.

To provide further strength, all or some of the wall panels can be of composite form and comprise corrugated board and a length of wire, the wire being secured to one face of the board and serving to reinforce the panel. Said wire can include an upper horizontal portion, a lower horizontal portion and vertical portions defining a frame. Where wall panels have flaps at each end thereof, said wire can extend into the flaps.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE DRAWINGS

Figure 1:
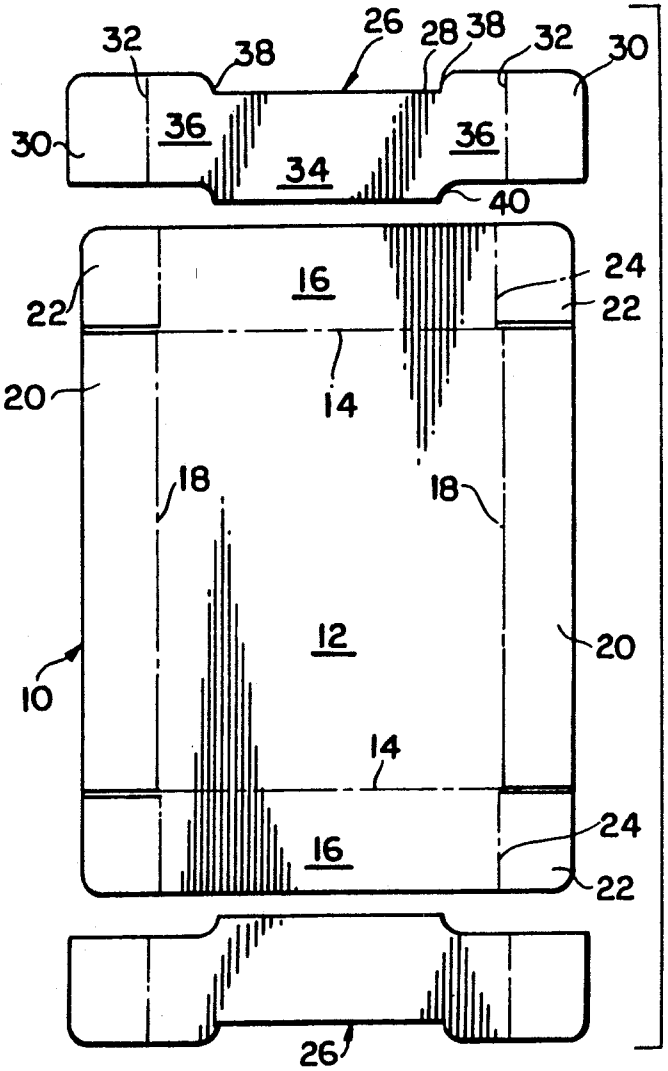
FIG. 1 is a plan view illustrating a kit from which a box can be erected.

Referring firstly to FIG. 1, the centre one of the three blanks illustrated is designated 10 and is of corrugated board. The blank 10 includes a rectangular base panel 12 which is joined along parallel crease lines 14 to end wall panels 16 and along parallel of crease lines 18 to side wall panels 20. Flaps 22 are connected along crease lines 24 to both ends of each end wall panel 16. It will be noted that the width of each panel 16, measured from the crease line 14 to the free edge of the panel 16, is greater in the preferred form than the width of each side wall panel 20 measured between the crease line 18 and the free edge of the side wall panel 20. The remaining two blanks illustrated in FIG. 1 are each designated 26. Each of these blanks comprises a wall panel 28 and end flaps 30 connected to the wall panel 28 along crease lines 32. The length of each wall panel 28 between the crease lines 32 is slightly longer than the length of each end wall panel 16 between the crease lines 24.

Each panel 28 comprises a centre section 34 and two end sections 36. The configuration is such that when the blank 26 is standing vertically, the end sections 36 are offset vertically with respect to the centre section 34 thereby to provide steps 38 and 40 in the upper and lower edges of the blanks 26. Each end flap 30 forms part of one of the sections 36.

As will be described in more detail hereinafter, the centre and end sections 34 and 36 are coated with re-activatable adhesive. If the adhesive is of the type which requires both of the components that are to be secured to have re-activatable adhesive thereon, then those faces of the end wall panels 16 which face outwardly in the erected box and the outwardly facing end portions of the side wall panels 20 are also coated with adhesive.

Figure 2:
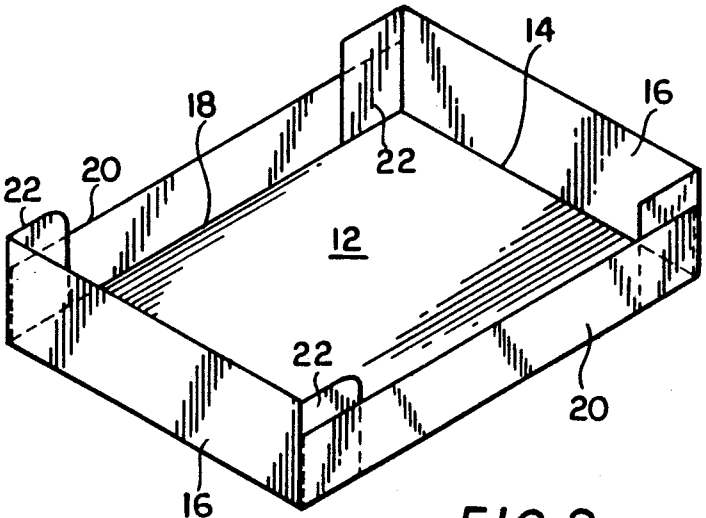
FIG. 2 illustrates the larger of the three blanks of FIG. 1 in its erected condition.

The box is erected by folding the blank 10 about the crease lines 14 to standup the end wall panels 16 and then folding the blank again about the crease lines 24 so that the flaps 22 extend at right angles to the end wall panels 16. Thereafter, the blank 10 is folded again about the crease lines 18 so that the side wall panels 20 stand up, the flaps 22 being adjacent the inner faces of the end portions of the side wall panels 20. The partially erected box is then as shown in FIG. 2.

Figure 3:
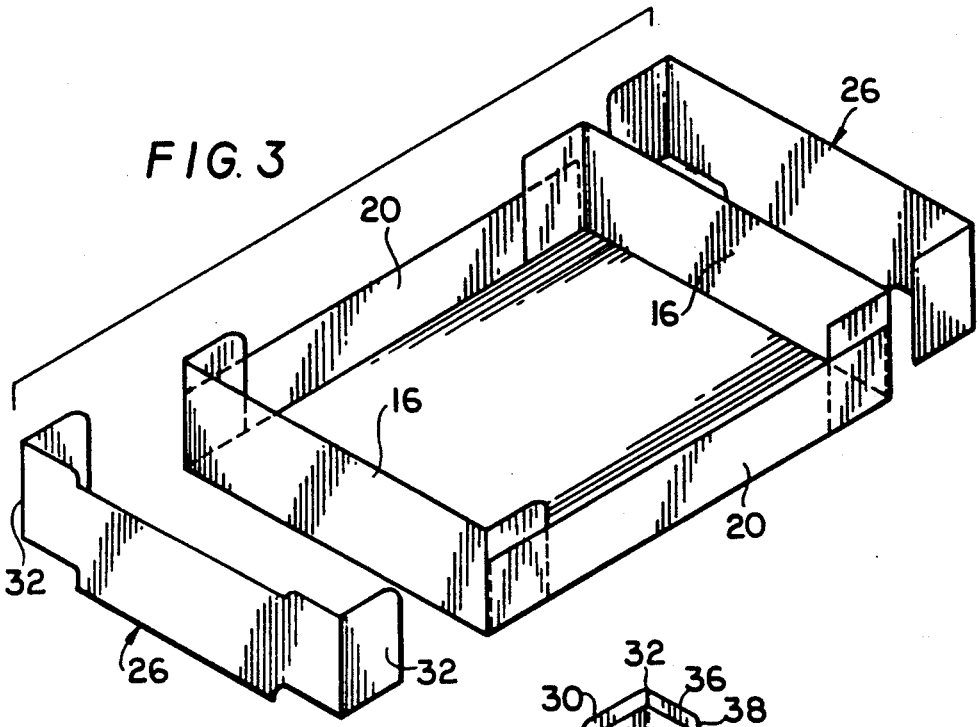
FIG. 3 illustrates the way in which the remaining two blanks of FIG. 1 are attached to the blank of FIG. 2.

The adhesive on the blanks 26, and on the outer faces of the panels 16 and 20 if applicable, is then re-activated and the blanks 26 folded about the crease lines 32 so that the end flaps 30 are at right angles to the sections 34, 36 as shown in FIG. 3. The blanks 26 are then positioned as shown in FIG. 3 and adhered to the outer faces of the panels 16 and 20.

Figure 4:
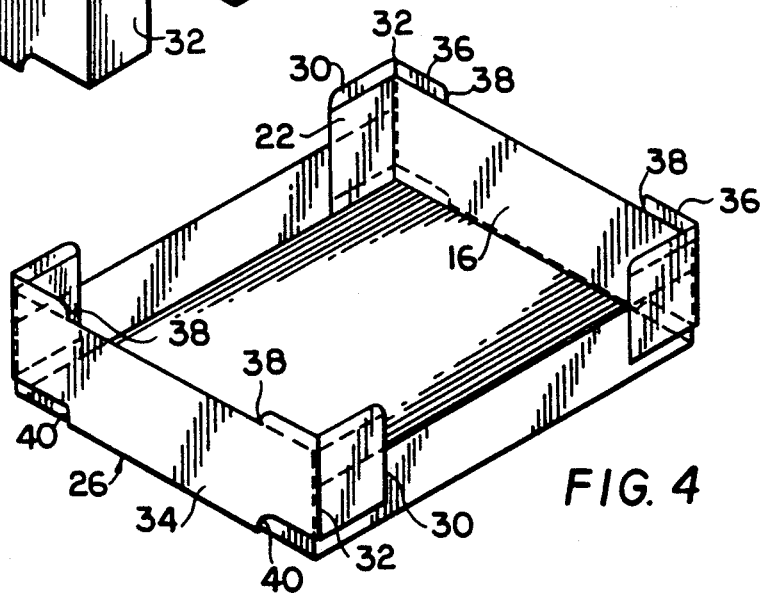
FIG. 4 illustrates an erected box.

As will be seen from FIG. 4, the upper and lower edges of the centre section 34 co-incide with the upper and lower edges of the end wall panels 16. Outwardly of the steps 38 the end sections 36 protrude upwardly above the upper edges of the end wall panels 16. Outwardly of the steps 40 the lower edges of the end sections 36 are above the lower edges of the end wall panels 16. Likewise, the upper edges of the flaps 30 are above the upper edges of the flaps 22 and the lower edges of the flaps 30 are above the lower edges of the side wall panels 20.

Various types of re-activatable adhesive can be used. These are:

Hot Melt

Hot melt adhesive must be re-activated by heat. If this adhesive is used only the blanks 26 need be coated with it and the adhesive can be re-activated by blowing hot air onto it or by subjecting it to radiant heat.

Solvent based adhesive

Adhesives of this nature are re-activated by appropriate solvents. Only the blanks 26 have to be coated with this form of adhesive.

Latex based adhesive

If this adhesive is used then not only the blanks 26 but also the outer faces of the end wall panels 16 and the outer faces of the end portions of the side wall panels 20 must be coated.

Contact adhesives

These adhesives must also be coated onto both the components that are to be secured and are solvent based.

Water based adhesive

This is re-activated by the application of water and need only be coated on the blanks 26.

Figure 5:
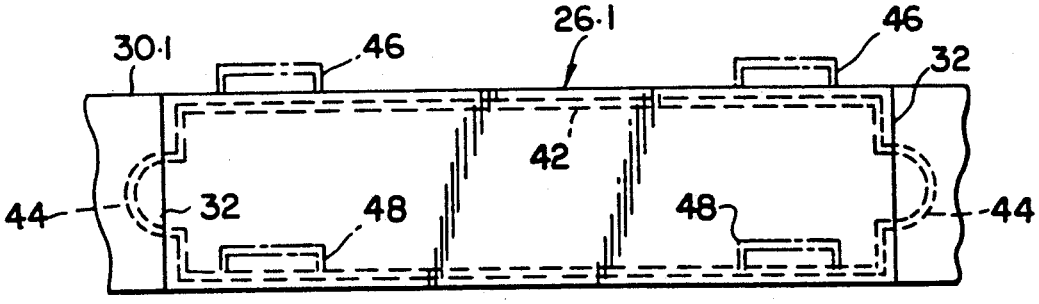
FIG. 5 illustrates a re-inforced end wall.

Turning now to FIG. 5, this illustrates a modification of the blank 26 which has a wire frame 42 secured to it. The wire frame 42 can be secured to one face of the blank 26.1 or can be sandwiched between two layers of corrugated board which are adhered to one another. It will be noted that ears 44 of the wire frame 42 protrude beyond the crease lines 32 into the areas of the end flaps 30.1. When the blank 26.1 is folded to the position shown in FIG. 3, the ears 44 are bent around with the end flaps 30.1.

If the ears 44 are omitted then the wire frame 42 is of rectangular shape comprising an upper horizontal portion and a lower horizontal portion joined by two vertical portions. The chain-dotted lines in FIG. 5 illustrate a modification of the wire frame. The upper horizontal portion protrudes above the blank 26 to form two ears 46. The lower horizontal portion is bent upwardly at two locations to form two recesses 48. When two boxes are stacked, the ears 46 of a lower box enter the recesses 48 of an upper box thereby to form an additional interlock. It is possible, of course, when the ears 46 are provided, to omit the interlock constituted by the steps 38 and 40 and rely on the ears 46 and recesses 48 to inhibit relative motion between boxes.

The term 're-activatable' as used herein to define the type of adhesive means that the adhesive, after being coated onto a blank and allowed to dry, will not stick to another blank unless water, solvent or heat is first applied. It also encompasses adhesives which present a non-tacky surface after being applied and allowed to dry and will thereafter only bond when pressed against a further blank which is coated with the same or a compatible adhesive.

I claim:

1. A box comprising a first blank including a rectangular base panel having edges, two opposed pairs of wall panels standing upright along the edges of the base panel, the wall panels having ends, upper and lower edges and inner and outer faces, end flaps joined to the ends of one opposed pair of wall panels of the first blank, said end flaps being adjacent the inner faces of the other opposed pair of wall panels of the first blank and second and third blanks each of which includes a wall panel and two end flaps, each wall panel having ends and upper and lower edges, said end flaps being joined to said ends of the wall panels of the second and third blanks, the wall panels of the second and third blanks being adhered to the outer faces of said one opposed pair of wall panels of the first blank and the flaps of the second and third blanks being adhered to the outer faces of end portions of the other pair of opposed wall panels of the first blank, the wall panel of each second and third blank comprises a centre section the width of which is equal to the height of the wall panel of the first blank to which it is secured, and two end sections which are displaced vertically in the same direction with respect to the centre section thereby to provide steps in the upper and lower edges of the second and third blanks, the upper and lower edges of said centre sections co-inciding with the upper and lower edges of the wall panels of said one opposed pair, and the upper and lower edges of the end sections lying above or below the upper and lower edges respectively of the wall panels of the said one pair.

2. A box according to claim 1 in which the upper edges of said end sections are above the upper edges of the wall panels of said one opposed pair and the lower edges of said end sections are above the lower edges of the wall panels of said opposed pair.

3. A stack of boxes, each box being according to claim 1 in which said end sections interlock and said steps are in contact with one another whereby lateral shifting of the boxes with respect to one another is prevented.

4. A kit from which a box can be erected, the kit comprises first, second and third blanks which in the erected box are adhered to one another, the first blank including a rectangular base panel having four edges, opposed end wall panels and opposed side wall panels jointed to the base panel along the four edges thereof, said end wall panels having ends and inner and outer faces, end flaps joined to said ends of the end wall panels of the first blank, each of the second and third blanks comprising a wall panel having upper and lower edges and which is longer than the end wall panels of the first blank, the wall panels of the second and third blanks having ends and there being end flaps at the ends of said wall panels, at least the second and third blanks having thereon re-activatable adhesive for permitting said second and third blanks to be adhered to the outer faces of the end wall panels of the first blank, the wall panel of each second and third blank comprises a centre section the width of which is equal to the erected height of the end wall panel of the first blank to which it is to be secured, and two end sections which are displaced in the same direction with respect to the centre section thereby to provide steps in both the upper edges and the lower edges of said end wall panels of the second and third blanks.

5. A kit according to claim 4, in which said centre section and said end section are of the same width.

6. A method of erecting a box the method comprising:

cutting a first blank including a rectangular base panel having four edges and end and side wall panels jointed to the base panel along the four edges thereof, said wall panels having outer faces;

cutting second and third blanks each comprising a wall panel having ends and which wall panels are longer than the end wall panels of the first blank and which have end flaps at the ends thereof;

applying re-activatable adhesive to the cut blanks and permitting the adhesive to dry and an inactive state; folding the wall panels of the first blank upwardly with respect to the base panel so that they are erect; folding the end flaps of the second and third blanks so that they are at right angles to the wall panels of the second and third blanks; and adhering the wall panels of the second and third blanks to the outer faces of the end wall panels of the first blank and adhering the end flaps of the second and third blanks to the outer faces of the end portions of the side wall panels of the first blank using said re-activatable adhesive.

7. A method according to claim 6 and including the step of re-activating the inactive adhesive and using the re-activated adhesive to adhere the blanks together.

8. A method according to claim 6 in which said re-activatable adhesive is pressure sensitive adhesive, and wherein said blanks are adhered together by pressing them against one another.

* * * * *